US005503583A

United States Patent [19]

Hippely et al.

[11] Patent Number: 5,503,583

[45] Date of Patent: Apr. 2, 1996

[54] TOY WITH THERMOCHROMIC MATERIAL

[75] Inventors: Keith Hippely, Manhattan Beach; Larry R. Wood, Redondo Beach; Jill E. Barad, Pacific Palisades; Prodromos Papavasiliou, Torrance, all of Calif.

[73] Assignee: Mattel, Inc., El Segundo, Calif.

[21] Appl. No.: 422,632

[22] Filed: Apr. 14, 1995

Related U.S. Application Data

[63] Continuation of Ser. No. 918,882, Jul. 23, 1992, abandoned, which is a continuation of Ser. No. 790,136, Nov. 7, 1991, abandoned, which is a continuation of Ser. No. 474,654, Feb. 2, 1990, abandoned, which is a continuation of Ser. No. 167,614, Mar. 14, 1988, abandoned, which is a continuation-in-part of Ser. No. 67,519, Jun. 26, 1987, Pat. No. 4,917,643.

[51] Int. Cl.[6] ..... A63H 33/00; A63H 3/36

[52] U.S. Cl. ..... 446/14; 446/337; 446/390; 446/391

[58] Field of Search ..... 446/14, 100, 321, 446/337, 390, 391, 392, 395, 369, 372; 434/98, 99, 100; 106/21

[56] References Cited

U.S. PATENT DOCUMENTS

| | | | |
|---|---|---|---|
| 1,555,644 | 9/1925 | Duncan | 446/321 |
| 1,770,147 | 7/1930 | Silver et al. | 446/390 |
| 2,519,922 | 8/1950 | Newbury | 434/99 |
| 2,656,647 | 10/1953 | Schepp . | |
| 2,691,846 | 10/1954 | Fruhling | 446/391 X |
| 2,921,407 | 1/1960 | Wagner et al. . | |
| 3,262,386 | 7/1966 | Gordon . | |
| 3,382,607 | 5/1968 | Ryan et al. | 446/296 |
| 3,451,143 | 6/1969 | Thomas et al. . | |
| 3,617,324 | 11/1971 | Thomas . | |
| 3,655,256 | 4/1972 | Claytor et al. . | |
| 3,691,679 | 9/1972 | Kernsten | 446/390 X |
| 3,831,165 | 8/1974 | Chivian et al. . | |
| 3,980,300 | 9/1976 | Hornsby, Jr. | 273/58 B |
| 4,028,118 | 6/1977 | Nakasuji et al. | 106/31 X |
| 4,134,853 | 1/1979 | Ehrlich et al. | 252/600 |
| 4,215,208 | 7/1980 | Yee et al. . | |
| 4,421,560 | 12/1983 | Kito et al. | 427/151 X |
| 4,425,161 | 1/1984 | Shibahashi et al. | 427/148 |
| 4,444,819 | 4/1984 | Maruta et al. | 503/209 |
| 4,462,616 | 7/1984 | Shanton | 503/210 |
| 4,554,565 | 11/1985 | Kito et al. | 428/913 X |
| 4,560,604 | 12/1985 | Shimizu et al. | 428/87 |
| 4,567,019 | 1/1986 | Lawton | 422/57 |
| 4,578,046 | 3/1986 | Ohno | 446/487 X |
| 4,611,072 | 9/1986 | Nachbur et al. | 556/135 |
| 4,674,985 | 6/1987 | Orenstein et al. | 446/14 |
| 4,681,791 | 6/1987 | Shibahashi et al. | 428/372 X |
| 4,717,710 | 1/1988 | Shimizu et al. | 428/913 X |
| 4,720,301 | 1/1988 | Kito et al. | 106/21 |
| 4,826,550 | 5/1989 | Shimizu et al. | 446/14 X |
| 4,917,643 | 4/1990 | Hippely et al. | 446/14 |

FOREIGN PATENT DOCUMENTS

| | | | |
|---|---|---|---|
| 2559676 | 8/1985 | France | 446/100 |
| 2066089 | 7/1981 | United Kingdom | 446/392 |
| 2205255 | 12/1988 | United Kingdom | 446/14 |
| WO86/02855 | 5/1986 | WIPO | 446/369 |
| 8602855 | 5/1986 | WIPO | 446/369 |

OTHER PUBLICATIONS

"Hello Color" Toys, *Playthings* Magazine, Feb. 1985, p. 329.

*Primary Examiner*—Sam Rimell
*Assistant Examiner*—D. Neal Muir
*Attorney, Agent, or Firm*—Poms, Smith, Lande & Rose

[57] ABSTRACT

A toy painted with paint containing thermochromic material which changes color as the temperature of the toy varies. Selected portions of the toy may be painted with the thermochromic material to provide a variety of patterns, designs, numbers, letters or other indicia which change color in response to temperature variations. In addition, different portions of the toy may be painted with different paints containing different colored thermochromic materials.

24 Claims, 2 Drawing Sheets

TOY WITH THERMOCHROMIC MATERIAL

CROSS-REFERENCE TO RELATED APPLICATION

This is a continuation of application, Ser. No. 07/918,882, now abandoned filed Jul. 23, 1992; which is a continuation of Ser. No. 07/790,136, filed Nov. 7, 1991, now abandoned; which is a continuation of Ser. No. 07/474,654, filed Feb. 2, 1990, now abandoned; which is a continuation of Ser. No. 07/167,614, filed Mar. 14, 1988, now abandoned; which is a continuation-in-part of Ser. No. 07/067,519, filed Jun. 26, 1987, now U.S. Pat. No. 4,917,643, granted Apr. 17, 1990.

BACKGROUND OF THE INVENTION

The present invention relates generally to toys and, more particularly, to a toy painted with a paint containing thermochromic material which changes color as the temperature of the toy varies.

In the past, a variety of toys have been developed with color-changing features using thermochromic or light-sensitive materials embedded or mixed in plastic, printed on paper or plastic, or impregnated in fibers used for clothing, doll hair, plush figures, or the like. For example, U.S. Pat. Nos. 4,560,604 issued to Shimizu et al., on Dec. 24, 1985 (coating fibers used for stuffed toys with thermochromic material); 4,134,853 issued to Ehrlich et al. on Jan. 16, 1979 (photochromic composition combined with moldable materials for forming toys); and 3,980,300 issued to Hornsby, Jr. on Sep. 14, 1976 (layer of liquid crystalline material used for ball) which disclose the use of such materials in toys. British Patent No. GB 2,066,089A issued to Rickson on Jul. 8, 1981 describes the use of temperature-sensitive cholesteric liquid crystal material for changing the color of the eyes of a doll. U.S. Pat. No. 3,382,607 issued to Ryan et al. on May 14, 1968 discloses a figure toy having synthetic hair fibers impregnated with an indicator dye which changes color in response to contact with liquids of different pH concentrations.

Thermochromic materials are disclosed in U.S. Pat. Nos. 4,567,019 issued to Lawton on Jan. 28, 1986; 4,421,560 issued to Kito et al. on Dec. 20, 1983; and 4,028,118 issued to Nakasuji et al. on Jun. 7, 1977. Heat-sensitive recording materials are described in U.S. Pat. Nos. 4,611,072 issued to Nachbar et al.; 4,462,616 issued to Shanton on Jul. 31, 1984; and 4,444,819 issued to Maruta et al. A reversible heat sensitive recording composition is disclosed in U.S. Pat. No. 4,720,301 issued to Kito et al. on Jan. 19, 1988.

None of the above patents discloses a toy painted with a paint containing thermochromic material which is capable of changing color as the temperature of the toy varies. A toy such as a miniature die-cast vehicle painted with paint containing thermochromic material provides numerous play options. For example, a child could pretend that such a toy vehicle is being painted by immersing it in heated or cold water causing the color of the vehicle to change. A child could also vary the color of such a vehicle using heated or cold air, ice, heated pens, heated brushes, light bulbs, heat blankets, or the heat of his or her hands. The toy vehicle could be made out of any material such as metal or plastic. Likewise, a toy such as a doll could have portions thereof such as the doll's lips, eyebrows, eyelashes, fingernails, cheeks, etc., painted with paint containing thermochromic material. As a result, a child would be able to vary the color of the doll's lips, eyebrows, eyelashes, etc. by applying hot or cold water to the painted portions of the doll or otherwise changing the temperature of the painted portions, causing the color of the thermochromic material to change. Accordingly, there is a need in the toy manufacturing arts for such a toy.

SUMMARY OF THE INVENTION

It is an object of this invention to provide a toy painted with paint containing thermochromic material which changes color as the temperature of the toy varies.

It is another object of this invention to provide a toy vehicle which is spray painted with paint containing thermochromic material.

It is still another object of this invention to provide a toy vehicle having only portions thereof spray painted with paint containing thermochromic material to produce a variety of patterns, designs, numbers, letters or other indicia which change color as the temperature of the vehicle varies.

It is still another object of this invention to provide a toy vehicle having different portions thereof spray painted with different paints containing different colored thermochromic materials which change color as the temperature of the vehicle varies.

It is still another object of this invention to provide a toy vehicle having portions thereof colored with inks and other portions thereof painted with paint containing thermochromic material.

It is still another object of this invention to provide a toy doll having portions thereof painted with paint containing thermochromic material which changes color as the temperature of the doll varies.

It is still another object of this invention to provide a toy doll having the doll's lips, eyebrows, eyelashes, eyes, fingernails, cheeks, and/or other portions painted with a paint containing thermochromic material which changes color as the temperature of the doll varies.

These and other objects and advantages are attained by a toy vehicle spray painted with paint containing thermochromic material which changes color as the temperature of the vehicle varies. Selected portions of the toy vehicle may be painted with the paint containing thermochromic material to provide variety of patterns, designs, numbers, letters, or other indicia which change color in response to temperature variations. In addition, different portions of the toy vehicle may be painted with different paints containing different colored thermochromic materials.

These and other objects and advantages are also attained by another embodiment of the present invention as above doll having its eyebrows, eyelashes, eyes, beauty mark, areas a the eyes, cheeks, fingernails, and/or other portions painted with a paint containing thermochromic material which changes color as the temperature of the doll varies. As such, a child may apply cold water to the doll's cheeks darkening the color of the cheeks so that the doll appears to be blushing. The cheeks may be returned to their original color by applying hot water to cheeks. The color of the other portions of the doll painted with paint containing thermochromic material such as the doll's eyes, eyelashes, fingernails, etc. may also be changed by applying hot or cold water to these painted portions of the doll.

The various features of the present invention will be best understood together with further objects and advantages by reference to the following description of the preferred embodiments taken in connection with the accompanying drawings.

DESCRIPTION OF THE PREFERRED EMBODIMENTS

The following specification taken in conjunction with the drawings sets forth the preferred embodiments of the present invention in such a manner that any person skilled in the toy manufacturing arts can use the invention. It is intended that the present invention includes any toy painted with a paint containing thermochromic material which changes color as the temperature of the toy varies. The embodiments disclosed herein are the best modes contemplated by the inventors for carrying out their invention in a commercial environment although it should be understood that various modifications can be accomplished within the parameters of the present invention.

Figure 1:
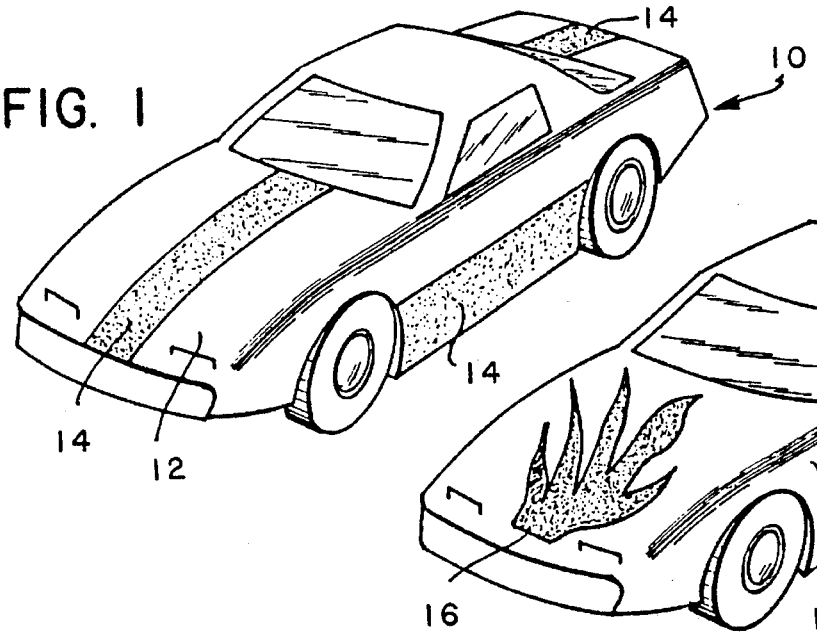
FIG. 1 is a perspective view of an embodiment of the present invention as a toy vehicle having a portion thereof painted with paint containing thermochromic material.
Figure 2:
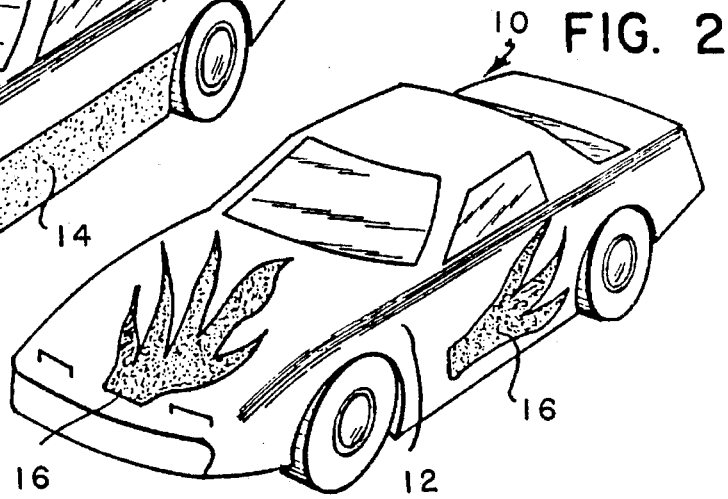
FIGS. 2 through 4 are perspective views of other embodiments of the toy vehicle of the present invention having different portions thereof painted with paint containing thermochromic material to provide a variety of patterns, designs, numbers, letters or other indicia.
Figure 3:
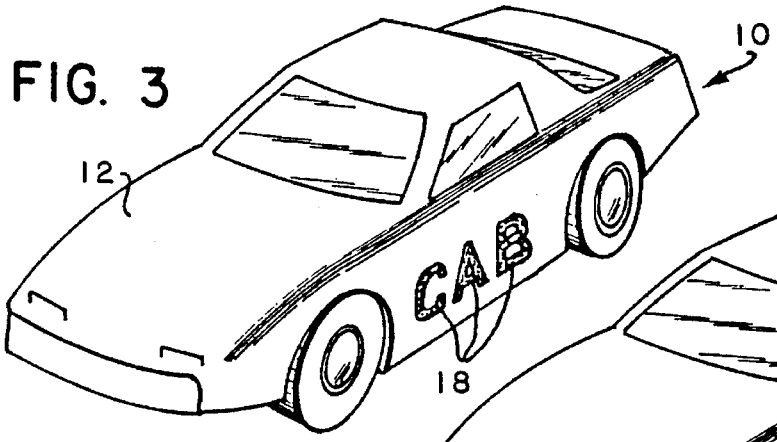
Figure 4:
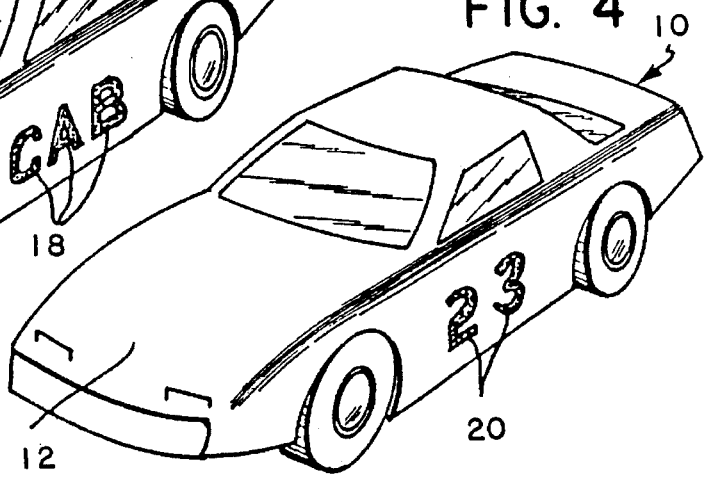

Referring now to the drawings and particularly to FIG. 1, a toy vehicle 10 of the present invention having a body 12 is disclosed. The body 12 is painted with paint containing thermochromic material at portions thereof to provide a pattern or stripes 14 as illustrated. Alternatively, the body 12 may be painted with thermochromic material at different portions thereof to provide a variety of designs 16, letters 18, numbers 20 or other indicia (not shown) as illustrated in FIGS. 2 through 4. In addition, the entire body 12 may be painted with paint containing thermochromic material if desired (not shown). It is important to point out that any portion or all of the body 12 may be painted with paint containing thermochromic material to provide any desirable design, pattern, number, letter or indicia.

Figure 5:
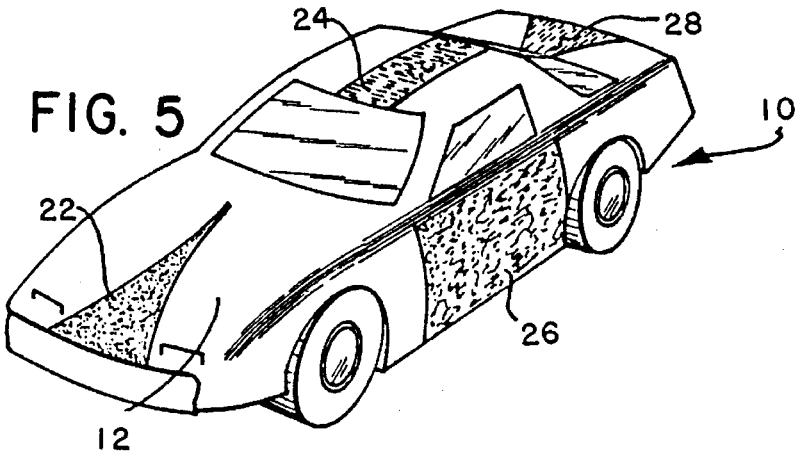
FIG. 5 is a perspective view of another embodiment of the toy vehicle of the present invention having different portions thereof painted with different paints containing different colored thermochromic materials.

FIG. 5 shows another embodiment of the toy vehicle 10. The body 12 of the vehicle 10 has different portions 22 through 28 thereof painted with different paints containing different colored thermochromic materials so that each portion has a different colored thermochromic material. Alternatively, some of the portions 22 through 28 may have the same colored thermochromic material. As another alternative, the thermochromic materials of one or some of the portions 22 through 28 may change color at different temperatures.

Since the thermochromic material will change color as the temperature of the body 12 changes, a child may vary the appearance or color of the toy vehicle 10 by raising or lowering the temperature of the body 12. This may be accomplished by immmersing the toy vehicle 10 in heated or cold water, or using heated or cold air, ice, heated pens, heated brushes, light bulbs, heat blankets, etc. to change the temperature of the body 12. The heat of a child's hands may also be used to change the temperature of the body 12 and, thus, change the color of the thermochromic material. Generally, thermochromic material changes color from a darker color to a lighter color as the temperature of the material is increased.

Dramatic results may be obtained by changing the temperature of the body 12 or thermochromic material. For example, as the temperature changes the toy vehicle 10 shown in FIG. 3 changes from a private vehicle to a cab, or vice versa. Numerous other changes are possible such as changing a private vehicle into a police car, ambulance, etc. A particularly dramatic result is obtained if the color of the toy vehicle 10 changes from a color such as brown which may be used to simulate a "dirty look" to a lighter, brighter, or clear color to simulate a "clean look", thus simulating washing the toy vehicle 10. This may be accomplished by using a brown-colored thermochromic material which becomes clear or transparent as the temperature of the material or body 12 is heated to a certain temperature level revealing an underlying coat of paint (or color) which does not contain thermochromic material. The same result can be obtained by using a thermochromic material which changes from a brown color to a lighter color as the temperature increases.

The body 12 may be made out of any material such as metal or plastic. However, a miniature metal die-cast body 12 is preferable because a metal vehicle will stay warm or cold longer and, thus, retain its color longer than a plastic vehicle.

The body 12 of the toy vehicle 10 is preferably spray painted with a paint containing thermochromic material. Alternatively, the toy vehicle 10 may be painted with a paint containing thermochromic material by dipping the vehicle in the paint, using a brush to paint the vehicle, or using any other technique. The word "painted" as used herein is intended to include any means of coating the body 12 of the toy vehicle 10 with a paint containing thermochromic material. Likewise, the word "paint" as used herein is intended to include any material containing thermochromic material that is coated to the body 12 of the toy vehicle 10. Because the paint containing thermochromic material is painted onto the body 12, the color of the toy vehicle 10 is brighter than that of a vehicle made out of molded plastic material containing thermochromic material. In addition, a toy metal vehicle spray painted with thermochromic material will retain its color longer, or stay warm or cold longer, than a vehicle made out of molded thermochromic plastic material.

Figure 6:
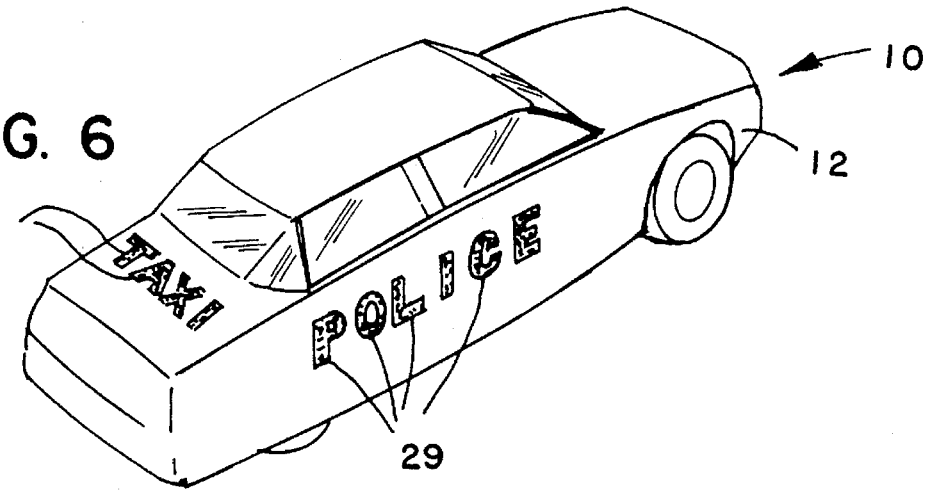
FIG. 6 is a perspective view of another embodiment of the toy vehicle of the present invention having portions thereof colored with inks and other portions thereof painted with paint containing thermochromic material.

FIG. 6 shows another embodiment of the toy vehicle 10. The body 12 is painted with paint containing thermochromic material and has portions 29 and 31 thereof painted, printed, inked or otherwise colored, without using thermochromic paint, to present different particular colors. Preferably, transferred pad printing is used with screen printing inks such as Fast Dry Enamel inks sold by Sinclair and Valentine, Screen Ink Division, North Kansas City, Mo., to color portions 29 and 31. However, any suitable type of ink, paint or material may be used to color portions 29 and 31 which does not change color in response to temperature variations. The ink used for portions 31 is substantially the same color as the thermochromic material contained in the paint used to paint body 12. Conversely, the ink used for portions 29 is a different color than the thermochromic material.

The colors of the thermochromic material and inks are selected so that the color of portions 31 matches that of body 12 before the temperature of body 12 is changed and is different than that of body 12 after the temperature is changed. For example, if portions 31 and body 12 are colored or painted with a light-colored ink or paint whose colors match and portions 29 are colored with a darker-colored ink, then the color of the thermochromic material of the paint used for body 12 will darken if the temperature of body 12 is lowered, such as by dipping the vehicle 10 in cold water, while the colors of the inks used for portions 29 and 31 remain the same. As the thermochromic paint of body 12 darkens, the lighter color of portions 31 stands out from the darker color of body 12 as portions 31 suddenly seem to appear while the darker color of portions 29 blends in with the darker color of body 12 as portions 29 seem to disappear. Any desirable combination of colors may be used for the inks or paint used for portions 29 and 31 and body 12. Also, any desirable number of portions 29 and 31 may be used, and portions 29 and 31 may have any particular colors and represent any desirable designs, patterns, numbers, letters or indicia.

The thermochromic paint sprayed onto the body 12 may be thermochromic paint sold by Matsui Shikiso Chemical Co., Ltd., Kyoto, Japan, under the trademark Chromic Epoxy Spray Paint. The composition of the thermochromic paint sold under the above trademark is a trade secret of Matsui Shikiso Chemical Co., Ltd. However, this thermochromic paint contains microencapsulated thermochromic material mixed or blended with an epoxy resin material, a hardening agent such as that sold by the above-mentioned company under the trademark Chromic Epoxy Fixer and a diluting solvent such as Xylol (Xylene). The Chromic Epoxy Spray Paint has nine base colors: yellow, gold orange, vermilion, pink, fast blue, turquoise blue, green, brown and black. Matsui Shikiso Chemical Co., Ltd. has developed a method of spray painting the Chromic Epoxy Spray Paint onto a toy vehicle by spraying a first coat of the thermochromic paint onto the vehicle followed by heat treatment at 140 degrees C. for 5 minutes, and then spraying a second coat of the thermochromic paint followed by heat treatment at 140 degrees C. for 20 minutes. However, any number of coats (including only one coat) of thermochromic paint may be used and the heat treatment can be varied or eliminated if desired. It is important to note that any other type of thermochromic paint may be used instead of the above-mentioned Chromic Epoxy Spray Paint and any color paint or thermochromic material may be used. Also, the temperature ranges during which the thermochromic materials change color can be selected as desired.

Any suitable thermochromic material may be used for this invention such as, for example, the thermochromic materials disclosed in U.S. Pat. No. 4,028,118, issued to Nakasuji et al. on Jun. 7, 1977, the disclosure of which is hereby incorporated by reference, and disclosed in U.S. Pat. No. 4,421,560, issued to Kito et al. on Dec. 20, 1983, the disclosure of which is hereby incorporated by reference. Other materials that change color, like thermochromic materials in response to temperature changes, may also be used for this invention and are referred to herein as "thermochromic materials" such as, for example, the reversible heat sensitive recording composition disclosed in U.S. Pat. No. 4,720,301, issued to Kito et al. on Jan. 19, 1988, the disclosure of which is hereby incorporated by reference. As such, "thermochromic material" as used herein is intended to refer to any suitable material that changes color in response to temperature variations. The thermochromic paint used for this invention may be prepared using any of the thermochromic materials disclosed in U.S. Pat. Nos. 4,028,118; 4,421,560; and 4,720,301. The thermochromic material used is mixed with a film forming resin, an appropriate solvent, and a stabilizer when required.

Figure 7:
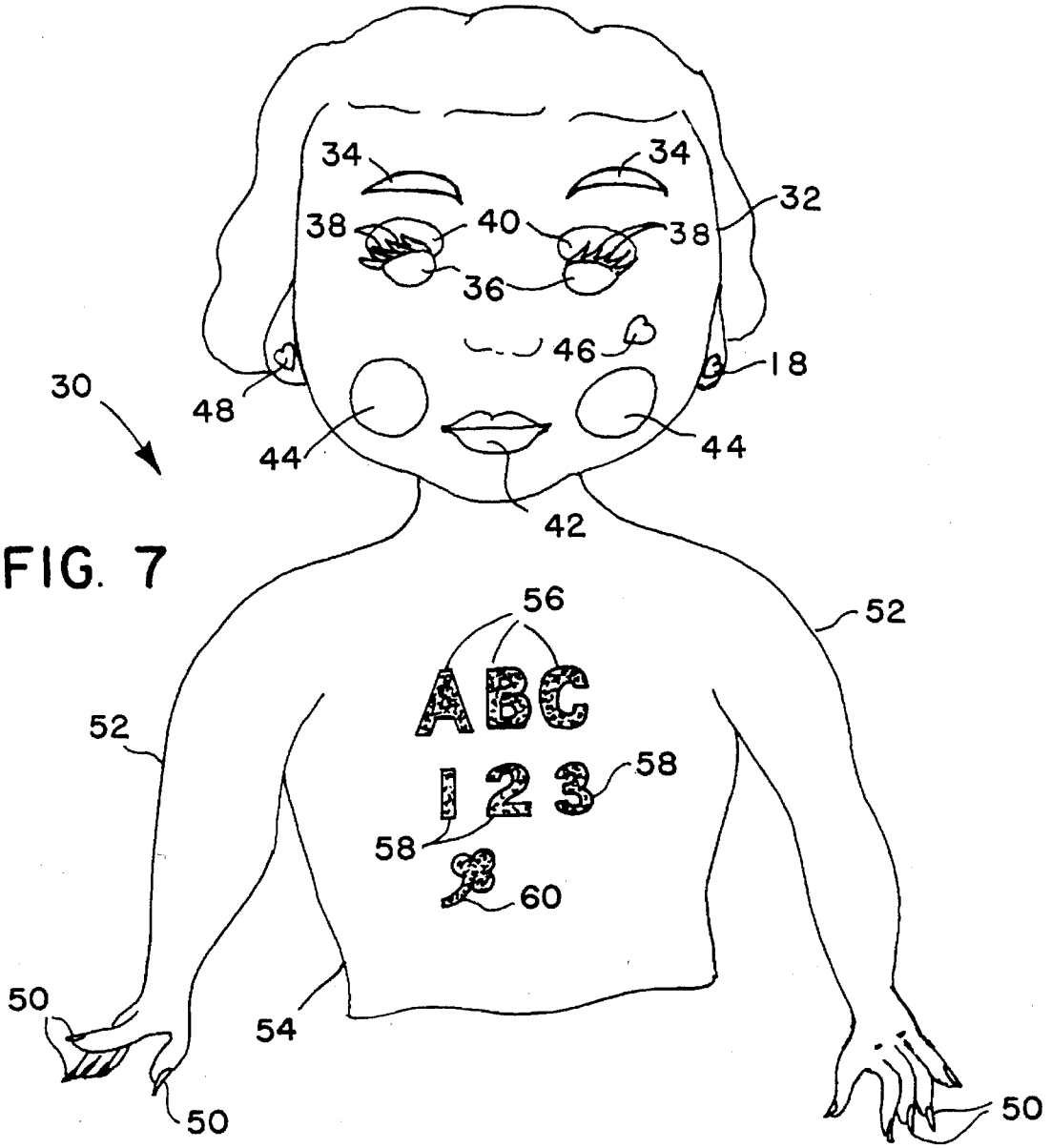
FIG. 7 is a front elevational view of another embodiment of the present invention as a toy doll having different portions thereof painted with paint containing thermochromic material.

FIG. 7 shows another embodiment of the present invention as a toy doll 30. The toy doll 30 has a head 32 with portions thereof painted with paint containing thermochromic material such as the doll's eyebrows 34, eyes 36, eyelashes 38, eyeshadow areas 40 above the eyes, lips 42, areas 44 at the doll's cheeks, heart-shaped beauty mark 46 on the doll's face, and heart-shaped earrings 48 on the doll's ears. Other portions of the doll 30 may be painted with paint containing thermochromic material such as the fingernails 50 or toenails (not shown) of the doll. Also, any other portion on any part of the doll 30 may be painted with thermochromic paint such as any portion of the arms 52, torso 54, legs (not shown), or other part of the doll. For example, the torso 54 of the doll 30 may have portions thereof representing letters 56, numbers 58, designs 60, or any other indicia painted with thermochromic paint. The head 32, arms 52, torso 54, legs or other part of the doll 30 may be made out of plastic or any other suitable material. The portions of the doll 30 painted with such paint may have any shape or present any design, letter, number or other indicia (not shown). In addition, any suitable thermochromic paint may be used for the doll 30.

A child may play with the doll 30 by applying hot or cold water to the portions of the doll painted with paint containing thermochromic material, thereby changing the temperature of the thermochromic material and causing the color of the material to change. For example, cold water may be applied to the doll's fingernails 50 so that the color of the thermochromic material contained in the thermochromic paint at the fingernails darkens, allowing the child to pretend that the fingernails are being painted with fingernail polish. The child may then return the fingernails 50 to their original color by applying hot water to the fingernails causing the color of the thermochromic material to lighten. Likewise, the colors of the thermochromic material contained in the thermochromic paint at the doll's eyebrows 34, eyes 36, eyelashes 38, eyeshadow areas 40, lips 42, cheek areas 44, mark 46, and earrings 48 may be darkened by applying cold water to these areas of the doll so that a child can pretend that make up or jewelry is being put on the doll. For example, the doll's cheek areas 44 may be darkened by applying cold water to these areas so a child can pretend that make up is being applied to the doll's cheeks or the doll is blushing. The darkened colors of these areas may then be returned to their original lighter colors by applying hot water as explained above.

Alternatively, the different portions of the doll 30 may be painted with different thermochromic paints containing different colored thermochromic materials, or some of the painted portions may have the same colored thermochromic material. In addition, the thermochromic materials of one or some of the painted portions of the doll 30 may change color at different temperatures. Also, thermochromic material may be used for the doll 30 that changes color from a colored opaque material to a transparent material when the temperature thereof is increased to reveal any underlying color, or that changes color from a transparent material to a colored opaque material when the temperature is lowered.

The above description discloses the preferred embodiments of the present invention. However, persons of ordinary skill in the toy field are capable of numerous modifications once taught these principles. Accordingly, it will be understood by those skilled in the art that changes in form and details may be made to the above-described embodiments without departing from the spirit and scope of the invention.

We claim:

1. A toy car comprising a toy car having at least one portion of said toy car body coated with thermochromic paint including thermochromic material coated to said toy car body capable of changing color due to temperature variation of said toy car body, said thermochromic paint having an initial color, said toy car body having at least another portion thereof colored with a non-thermochromic material having a particular color which combines with said initial color of said thermochromic paint to present an initial appearance for said toy car body, said thermochromic paint for changing said initial appearance to a substantially different appearance by changing said initial color in response to said temperature variation of said toy car body and for combining with said particular color to provide said substantially different appearance.

2. The toy car of claim 1 wherein said thermochromic paint is capable of changing color from said initial color at a first temperature to a second color at a second temperature so that said second color substantially matches said particular color of said non-thermochromic material at said second temperature.

3. The toy car of claim 1 wherein said thermochromic paint is capable of changing color from said initial color at a first temperature to a second color at a second temperature so that said second color is different than said particular color of said non-thermochromic material at said second temperature.

4. The toy car of claim 1 wherein said non-thermochromic material is screen printing ink.

5. The toy car of claim 1 wherein said car body has an additional portion thereof colored with another non-thermochromic material having another particular color, said thermochromic paint capable of changing color from said initial color at a first temperature to a second color at a second temperature so that said second color substantially matches said particular color of said non-thermochromic material at said second temperature and is different than said another particular color of said another non-thermochromic material at said second temperature.

6. A toy doll having an initial appearance comprising at least one nonfabric doll part having an initial appearance resulting from different outside surface portions of said doll part being coated with thermochromic paint means having an initial color, said thermochromic paint means for changing said initial appearance of said doll without the need to move said doll part by changing said initial appearance of said doll part and said initial color in response to temperature variation of said doll part in order to cause said outside surface portions to change color and to provide simulated doll features and enhancement areas on said doll part, said thermochromic paint means including thermochromic material coated to said outside surface portions capable of changing color due to said temperature variation.

7. The toy doll of claim 6 wherein said part is made out of plastic.

8. The toy doll of claim 6 wherein said portions of said part coated with said thermochromic paint means form a design.

9. The toy doll of claim 6 wherein said portions of said part coated with said thermochromic paint means form letters.

10. The toy doll of claim 6 wherein said portions of said part coated with said thermochromic paint means form numbers.

11. The toy doll of claim 6 wherein said doll has fingernails, said portions of said part coated with said thermochromic paint means being said fingernails.

12. The toy doll of claim 6 wherein said part is a head of said doll, said head having eyes, cheeks, and lips, said portions of said head coated with said thermochromic paint means including said lips, areas at said cheeks, areas above said eyes, and an area on said head representing a beauty mark.

13. The toy doll of claim 6 wherein said part is a head of a doll, said head having eyes, eyebrows and eyelashes, said portions of said head coated with said thermochromic paint means including said eyebrows, eyelashes and eyes.

14. The toy doll of claim 6 wherein said thermochromic material is capable of changing color from a colored opaque material to a transparent material and of changing color from a transparent material to a colored opaque material.

15. A toy doll having an initial appearance comprising at least one nonfabric doll part having an initial appearance resulting from a first outside surface portion thereof being coated with a first thermochromic paint means including a first thermochromic material coated to said first outside surface portion and a second outside surface portion thereof being coated with second thermochromic paint means including a second thermochromic material different from said first thermochromic material coated to said second outside surface portion, said first and second thermochromic materials being capable of changing color from a first color at a first temperature to a second color at a second temperature, said first and second thermochromic paint means for changing said initial appearance of said doll without the need to move said doll part by changing said initial appearance of said doll part and said first color of said first and second thermochromic materials to said second color in response to temperature variation of said doll part in order to cause said first and second outside surface portions to change color and to provide simulated doll features and enhancement areas on said doll part.

16. The toy doll of claim 15 wherein said first and second thermochromic materials have different first colors.

17. The toy doll of claim 16 wherein said first and second thermochromic materials change color to different second colors at about the same second temperature.

18. The toy doll of claim 16 wherein said first and second thermochromic materials change color to different second colors at different second temperatures.

19. The toy doll of claim 15 wherein said first and second thermochromic materials are capable of changing color from colored opaque materials to transparent materials and of changing color from transparent materials to colored opaque materials.

20. The toy doll of claim 15 wherein said first and second thermochromic materials have the same first color.

21. The toy doll of claim 20 wherein said first and second thermochromic materials change color to different second colors at about the same second temperature.

22. The toy doll of claim 20 wherein said first and second thermochromic materials change color to different second colors at different second temperatures.

23. A toy doll having an initial appearance comprising at least one nonfabric doll part having an initial appearance resulting from different outside surface portions of said doll part being coated with thermochromic paint means having an initial color, said thermochromic paint means for changing said initial appearance of said doll without the need to move said doll part by changing said initial appearance of said doll part and said initial color in response to temperature variation of said doll part in order to cause said outside surface portions to change color and to provide simulated doll features and enhancement areas on said doll part, said thermochromic paint means including thermochromic material coated to said outside surface portions capable of changing color due to said temperature variation, and said doll having lips and fingernails coated with said thermochromic paint.

24. A toy doll having an initial appearance comprising at least one nonfabric doll part having an initial appearance resulting from a first outside surface portion thereof being coated with a first thermochromic paint means including a first thermochromic material coated to said first outside surface portion and a second outside surface portion thereof being coated with second thermochromic paint means including a second thermochromic material different from said first thermochromic material coated to said second outside surface portion, said first and second thermochromic materials being capable of changing color from a first color at a first temperature to a second color at a second temperature, said first and second thermochromic paint means for changing said initial appearance of said doll without the need to move said doll part by changing said initial appearance of said doll part and said first color of said first and second thermochromic materials to said second color in response to temperature variation of said doll part in order to cause said first and second outside surface portions to change color and to provide simulated doll features and enhancement areas on said doll part, and said first and second thermochromic materials changing colors at different temperature.

* * * * *

US005503583B1

REEXAMINATION CERTIFICATE (4147th)

United States Patent [19] [11] B1 5,503,583

Hippely et al. [45] Certificate Issued Sep. 5, 2000

[54] TOY WITH THERMOCHROMIC MATERIAL

[75] Inventors: Keith Hippely, Manhattan Beach; Larry R. Wood, Redondo Beach; Jill E. Barad, Pacific Palisades; Prodromos Papavasiliou, Torrance, all of Calif.

[73] Assignee: Mattel, Inc., Hawthorne, Calif.

Reexamination Request:
No. 90/004,770, Sep. 29, 1997

Reexamination Certificate for:

| | |
|---|---|
| Patent No.: | **5,503,583** |
| Issued: | **Apr. 2, 1996** |
| Appl. No.: | **08/422,632** |
| Filed: | **Apr. 14, 1995** |

Related U.S. Application Data

[63] Continuation of application No. 07/918,882, Jul. 23, 1992, abandoned, which is a continuation of application No. 07/790,136, Nov. 7, 1991, abandoned, which is a continuation of application No. 07/474,654, Feb. 2, 1990, abandoned, which is a continuation of application No. 07/167,614, Mar. 14, 1988, abandoned, which is a continuation-in-part of application No. 07/067,519, Jun. 26, 1987, Pat. No. 4,917,643.

[51] Int. Cl.[7] ..... A63H 33/00; A63H 3/36

[52] U.S. Cl. ..... 446/14; 446/337; 446/370; 446/391

[58] Field of Search ..... 446/14, 100, 321, 446/337, 390, 391, 392, 395, 369, 372; 434/98, 99, 100; 106/21; 427/148; 428/31

[56] References Cited

U.S. PATENT DOCUMENTS

| | | | |
|---|---|---|---|
| 4,142,782 | 3/1979 | O'Brian . | |
| 4,421,560 | 12/1983 | Kito et al. | 106/21 |
| 4,717,710 | 1/1988 | Shimizu et al. . | |

FOREIGN PATENT DOCUMENTS

| | | |
|---|---|---|
| 50-90795 | 7/1979 | Japan . |
| 60-61088 | 4/1985 | Japan . |
| WO86/02855 | 5/1986 | WIPO . |

*Primary Examiner*—D. Neal Muir

[57] ABSTRACT

A toy painted with paint containing thermochromic material which changes color as the temperature of the toy varies. Selected portions of the toy may be painted with the thermochromic material to provide a variety of patterns, designs, numbers, letters or other indicia which change color in response to temperature variations. In addition, different portions of the toy may be painted with different paints containing different colored thermochromic materials.

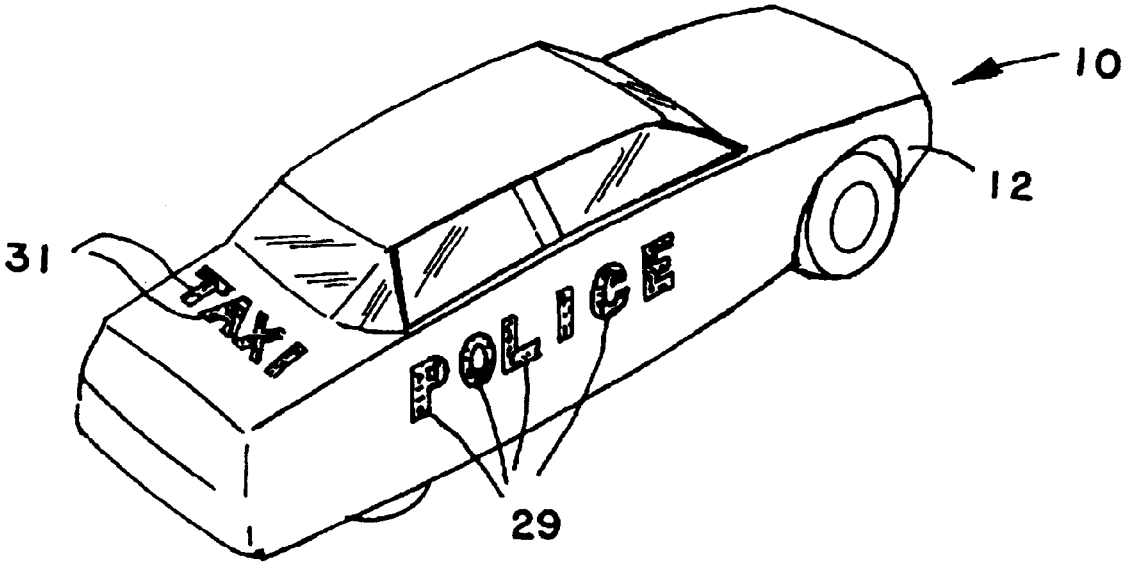

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 17 and 18 is confirmed.

Claims 1–3, 5–16, and 19–24 are cancelled.

Claim 4 is determined to be patentable as amended.

4. [The toy car of claim 1] *A toy car comprising a toy car body having;*

*at least one portion of said toy car body coated with thermochromic paint including thermochromic material coated to said toy car body capable of changing color due to temperature variation of said toy car body,*

*said thermochromic paint having an initial color, said toy car body having at least another portion thereof colored with a non-thermochromic material having a particular color which combines with said initial color of said thermochromic paint to present an initial appearance for said toy car body, said thermochromic paint for changing said initial appearance to a substantially different appearance by changing said initial color in response to said temperature variation of said toy car body and for combining with said particular color to provide said substantially different appearance; and*

*an additional portion of said toy car body colored with another non-thermochromic material having another particular color, said thermochromic paint capable of changing color from said initial color at a first temperature to a second color at a second temperature so that said second color substantially matches said particular color of said non-thermochromic material at said second temperature and is different than said another particular color of said another non-thermochromic material at said second temperature;* wherein said non-thermochomic material is screen printing ink.

* * * * *